US005591001A

United States Patent [19]

Ray et al.

[11] Patent Number: 5,591,001

[45] Date of Patent: Jan. 7, 1997

[54] AERATION SYSTEM

[75] Inventors: Robert B. Ray, Vancouver; Mark M. Qandil, Camas, both of Wash.; Gary L. Olin, Beaverton, Oreg.

[73] Assignee: Cornell Pump Manufacturing Corporation, Portland, Oreg.

[21] Appl. No.: 540,255

[22] Filed: Oct. 6, 1995

Related U.S. Application Data

[63] Continuation-in-part of Ser. No. 300,995, Sep. 6, 1994, Pat. No. 5,489,187.

[51] Int. Cl.[6] ..... F04D 29/10; F04D 31/00

[52] U.S. Cl. ..... 415/111; 415/116; 261/34.1; 261/DIG. 71

[58] Field of Search ..... 415/106, 111, 415/112, 116, 176; 261/28, 29, 34.1, 84, DIG. 71

[56] References Cited

U.S. PATENT DOCUMENTS

| | | | |
|---|---|---|---|
| 1,460,982 | 7/1923 | Records | 415/116 |
| 2,791,182 | 5/1957 | Scheidl | 415/116 |
| 3,128,713 | 4/1964 | Nechine | 415/111 |
| 3,663,117 | 5/1972 | Warren | 415/106 |
| 3,948,492 | 4/1976 | Hege . | |
| 4,193,949 | 3/1980 | Naito . | |
| 4,744,722 | 5/1988 | Sampi et al. | 415/116 |
| 4,780,051 | 10/1988 | Fisher, Jr. . | |
| 5,385,443 | 1/1995 | Dufour . | |
| 5,386,598 | 2/1995 | Mersmann . | |
| 5,427,500 | 6/1995 | Hyll | 415/111 |

*Primary Examiner*—James Larson
*Attorney, Agent, or Firm*—Kolisch, Hartwell, Dickinson, McCormack & Heuser

[57] ABSTRACT

A centrifugal pump having a rotatable impeller that operates to drain liquid into the intake of the pump. An air-introduction passage connects with a subatmospheric pressure region at the back of the impeller. Air introduced through this passage is mixed with a portion of the fluid pumped, and the air-fluid mixture is expelled as the discharge of the pump.

9 Claims, 3 Drawing Sheets

AERATION SYSTEM

This application is a continuation-in-part of prior filed application entitled IMPELLER PUMP WITH VANED BACKPLATE FOR CLEARING DEBRIS, filed Sep. 6, 1994 as Ser. No. 08/300,995, now U.S. Pat. No. 5,489,187.

BACKGROUND AND SUMMARY OF THE INVENTION

This invention relates to a centrifugal pump, and more particularly to a pump which conditions the fluid handled by the pump by introducing air into this fluid.

A pump of this description may be used for the production of an air and water mixture to be admitted to a tank holding a quantity of sewage. The air so introduced facilitates the removal of oil and other pollutants including solid particles which tend to separate out as a surface scum with the introduction of air and liquid to the tank. The aerated liquid produced by the pump of course may be used for other purposes.

It is known in the art that aeration of liquids is a useful procedure relied upon in pollution control operations. A known procedure, by way of example, is the aeration of sewage contained in a holding tank, with such tending to produce separation of pollutants in the liquid in the tank either as a scum or as sediment. A convenient approach for introducing such air would be to introduce air in the desired quantity to the suction or intake side of the pump during a pumping operation, with the pump then tending to produce a mixture of air and liquid which is expelled from the pump. The problem with this approach is that the addition of significant quantities of air to the intake of the pump will cause the pump to lose outlet pressure and stop pumping. Pump performance is also affected. U.S. Pat. No. 3,663,117 discloses a so-called aeration pump, wherein air is introduced against the front side of a pump impeller in a centrifugal pump, with the impeller vanes therein then producing mixing of the air and liquid pumped to produce aeration of the liquid. Such a system, because of the relatively high pressure condition existing adjacent the periphery of the impeller, requires a source of air at superatmospheric pressure to be supplied to the pump chamber. In another system, the liquid discharged from a pump is supplied to an air saturation tank. This tank is also supplied air from a compressed air source, and the air and liquid are then mixed in the tank. The need for an air compressor and other equipment adds to the complexity and expense of any system requiring a source of pressurized air.

A general object of this invention is to provide an improved method and apparatus for conditioning a liquid by the introduction of air into the liquid, with the air on introduction becoming dissolved in the liquid or entrained as a fine dispersion therein.

Another general object is to provide an improved sewage treatment method which utilizes recycled sewage conditioned with air in the treatment process.

Yet a further object is to provide an improved pump operable upon operation to produce a mixture of fluid and air, which operates without the requirement of a pressurized source of air.

A more specific object is the provision of such a pump, which employs air at atmospheric pressure introduced into a seal chamber in the pump, and structure within the seal chamber producing an air liquid mixture which under the action of the pump impeller moves to the periphery of the impeller and then to the pump discharge.

BRIEF DESCRIPTION OF THE DRAWINGS

These and other objects and advantages are obtained by the invention, which is described herein below in conjunction with the accompanying drawings, wherein.

DETAILED DESCRIPTION OF THE PREFERRED EMBODIMENT

Figure 1:
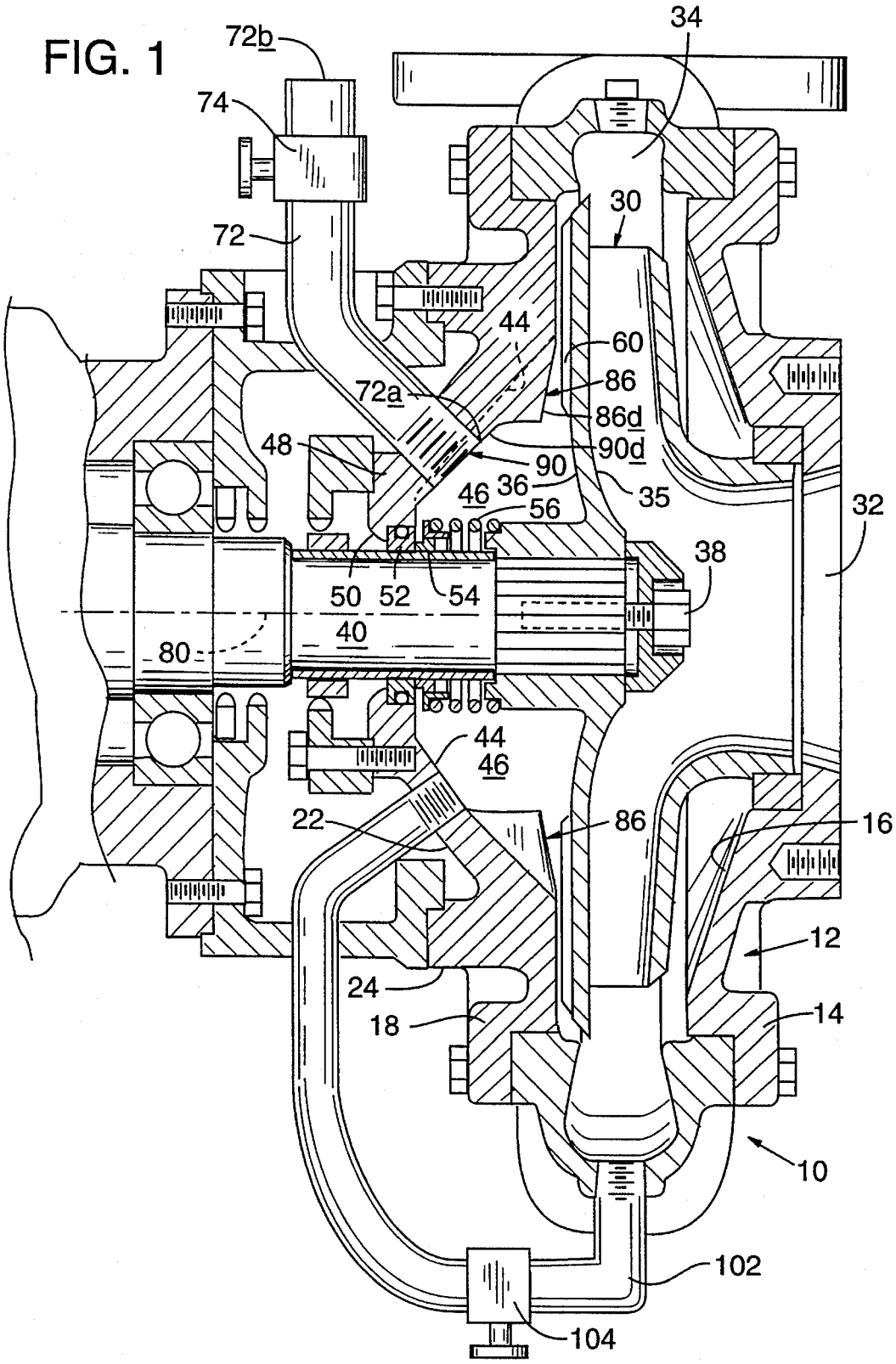
FIG. 1 is a cross sectional view of a centrifugal pump featuring a construction for a seal chamber in the pump as contemplated by the invention.

Referring now to the drawings, and first of all more particularly to FIG. 1, indicated generally at 10 is a centrifugal pump. The pump has a casing 12. Casing 12 includes a front casing section 14, with an internal pump chamber wall 16 defining a pump chamber having the usual volute configuration. Also part of the casing is a back casing section 18. These two casing sections are secured together in the pump. The back casing section includes a backplate portion 22 and a motor bracket portion 24.

A rotatable impeller 30 located within the pump chamber produces, on rotation, movement of the liquid being pumped or the pumpage. This liquid enters the pump chamber through an inlet opening or intake 32. Pressurized pumpage leaves the pump through pump discharge 34. The impeller has a front 35 and a back 36.

The impeller is detachably mounted, as by a fastener 38, on a forward end of a motor-driven impeller shaft 40. This shaft extends rearwardly, or outwardly from the back of the impeller, to a suitable power means such as an electric motor.

Backplate portion 22 has an inner wall 44, referred to as a seal chamber wall, which in general outline has a conical tapered or flaring shape. This wall and the back of the impeller bound what is referred to as a seal chamber or cavity 46. The seal chamber has a smaller diameter end located directly forwardly of hub 48. By reason of the taper of the seal chamber wall, the seal chamber enlarges progressing from this end to the opposite or large diameter end of the seal chamber or from left to right in FIG. 1. This is only one type of seal chamber, others are possible.

Hub 48 extends about an opening 50 which receives the impeller shaft. Seal structure exposed to the seal chamber seals the shaft and casing, and this structure comprises a stationary seal 52 and a rotary seal 54 which rotates with the impeller shaft. A compression spring 56 urges the rotary seal against the stationary seal. With the construction described, liquid within the seal chamber is prevented from leaking outwardly past the backplate.

During operation of the pump, part of the liquid being pumped flows into the seal chamber by moving about the periphery of the impeller and across the impeller's outer back margin. It is conventional to utilize this circulating fluid to produce cooling of the seal structure just described.

The back of the impeller may be provided with vanes indicated at 60. These vanes, when viewed in a direction extending toward the back of the impeller, ordinarily arcuately curve about the axis of the impeller shaft. By the inclusion of these vanes, a swirling action is introduced to the pumpage liquid which circulates in the seal chamber.

An air-introduction passage is provided along the inside of a conduit 72 having one end 72*a* which opens to the seal chamber and an opposite end 72*b* which opens to the atmosphere. Indicated at 74 is an adjustable valve which can be adjusted to control the amount of air introduced to the seal chamber by the conduit.

During operation of the pump and rotation of the impeller, pumpage is drawn in through the suction of the pump 32 and discharged at the periphery of the impeller through discharge 34. A negative or subatmospheric pressure is produced in an annular region extending about the impeller shaft adjacent the seal structure for the shaft comprising stationary and rotary seals 52, 54. Spring 56 functions to keep the seal faces in engagement against the action of this negative pressure. The negative pressure is effective to draw atmospheric air into the seal chamber into the negative pressure region through air-introduction conduit 72, with the amount of such air being controllable through controlling the adjustment of valve 74 (or by using a properly sized orifice).

Mixing of this air with the pumpage circulating at the rear of the impeller, and transporting of the mixture outwardly from the seal chamber to the stream of fluid being discharged from the pump at discharge 34, is promoted by stationary vane structure which is part of the back casing section 18.

Figure 3:
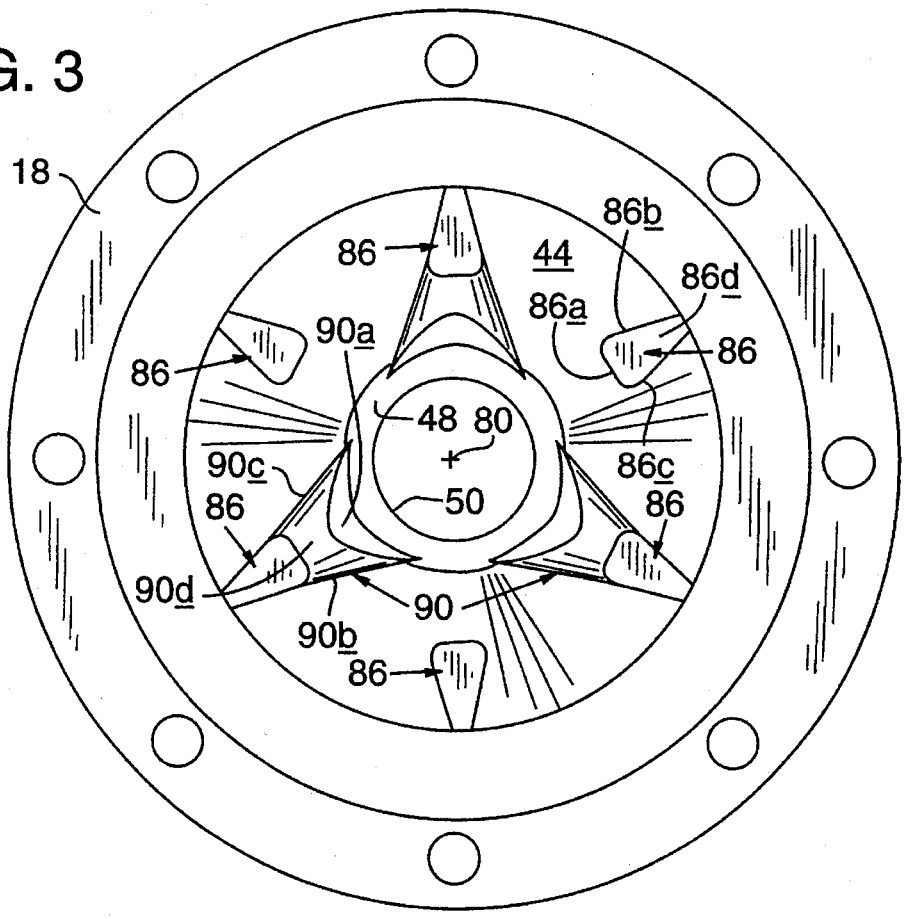
FIG. 3 is a view of the front of a backplate portion in the pump.

Further explaining, and referring also to FIG. 3, equally circumferentially distributed about axis 80 of the impeller shaft are multiple (namely six in the embodiment of the invention illustrated) outer vane segments 86. In frontal outline, as illustrated in FIG. 3, each of these outer vane segments has a shape which roughly may be described as a truncated triangle, and includes a base 86*a* and opposite sides 86*b*, 86*c*. Each vane projects outwardly from the seal chamber wall with its front face 86*d* extending at only a slight angle relative to a plane perpendicular to the axis of the shaft compared to the slope of the inclined pump seal chamber wall, which extends at a greater angle with respect to this plane. By reason of this incline, each outer vane segment has an increasing height or greater projection from the inclined pump seal chamber wall progressing in a radially inward direction on the seal chamber. Explaining a typical construction, face 86*d* might extend at an angle of approximately 10° with respect to a plane perpendicular to the axis of the shaft. In comparison, the tapered seal chamber wall might extend at an angle of approximately 35° with respect to this perpendicular plane. These specific values herein are given only as exemplary, and are subject to variation depending upon pump construction.

Distributed circumferentially about the shaft axis are multiple (three in the embodiment shown) inner vane segments 90. These extend inwardly on the seal chamber wall from the inner ends of alternate ones of the outer vane segments. Each inner vane segment has an arcuate, concavely curving base 90*a*, and opposite sides 90*b*, 90*c*, with these sides forming extensions of sides 86*b*, 86*c* of an outer vane segment. Sides 90*b*, 90*c* diverge from each other progressing in a radially inward direction. The front face 90*d* of an inner vane segment (refer to FIG. 1) inclines away from the tapered seal chamber wall progressing in a radially outward direction. As a result, these inner vane segments have increasing height increasing radially outwardly on the seal chamber. With the seal chamber wall inclining at an angle of approximately 35° with respect to a plane extending perpendicular to the axis of the impeller shaft, the face of an inner vane segment might incline at a somewhat greater angle with respect to this plane, for example, an angle of 45°.

The sides of the outer vane segments need not join with the faces of these respective vane segments at a sharp angle, but over a slight round, which tends to reduce excessive turbulence in the circulation of pumpage moving over the vanes.

Figure 4:
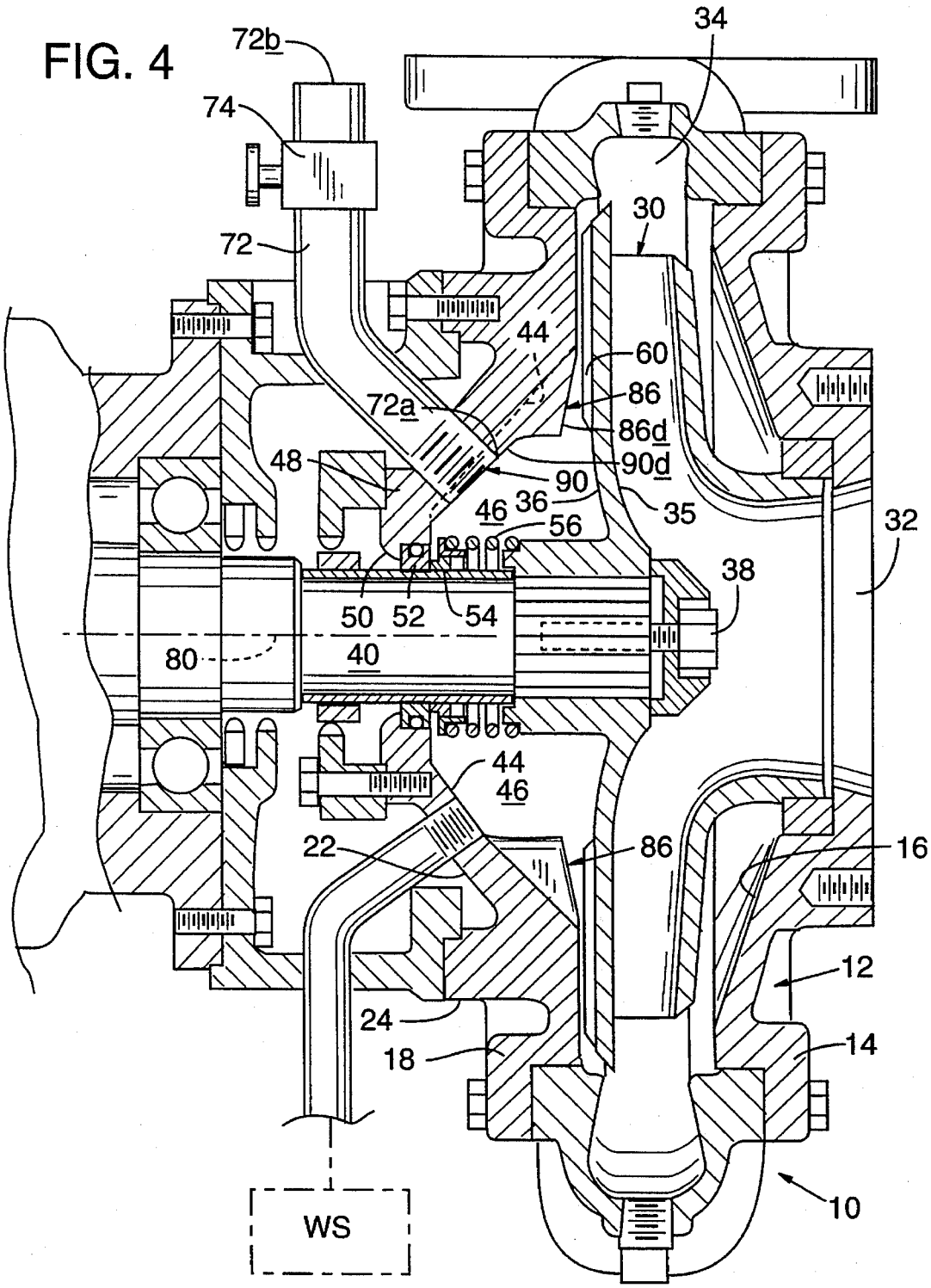
FIG. 4 is similar to FIG. 2 but illustrates a modification of the invention.

In the pump illustrated, a fluid circulation line or conduit is shown at 102, equipped with a valve 104. The conduit connects at one end with the interior of the pump casing at the periphery of the impeller. The opposite end connects with the seal chamber in the region of the seal chamber having a subatmospheric pressure. By including the circulation line, the amount of pumpage circulated to the seal chamber to be mixed with air may be increased over that which circulates to this seal chamber by moving over the periphery of the impeller. Optionally, liquid may be introduced to the seal chamber by a line connected to a pressurized water source. This is shown in FIG. 4 by the line connecting with the water source labeled "WS".

Describing the operation of the pump, the vane structure on the back of the impeller together with the normal rotation of the impeller causes pumpage within the seal chamber to swirl about as the impeller rotates. As this pumpage moves over the stationary vane structure projecting from the rear wall of the seal chamber, a vortexing action results tending to move debris, and also mixed pumpage and air, from the region of the seal chamber adjacent the impeller shaft radially outwardly, with this fluid and debris ultimately being expelled from the seal chamber by way of the back vanes 60 to become intermixed with the principal pumpage being pumped by the pump which is being discharged at discharge 34. There is a turbulence in the fluid pumped and a complex mixing arising by reason of vortexing occurring at the periphery of the impeller which enables pump fluid to enter the seal chamber at the same time that fluid mixed with air exits the seal chamber.

Figure 2:
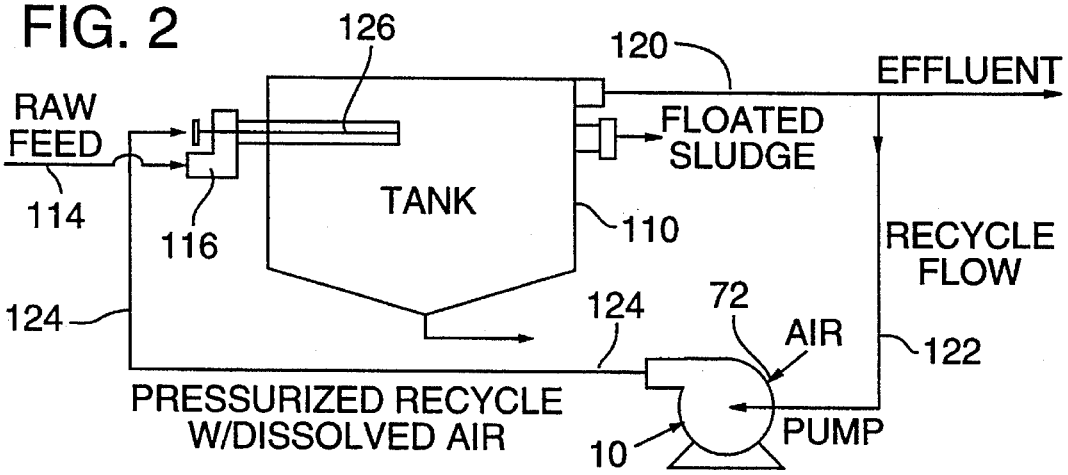
FIG. 2 is a schematic drawing illustrating a sewage treatment system utilizing a pump as described and shown in FIGS. 1 and 2.

A sewage system which utilizes the pump as described is illustrated in FIG. 2. Referring to this figure, a tank for containing a volume of sewage is illustrated at 110. Sewage is introduced to the tank from a raw sewage feed 114 introducing the sewage to the tank through a header box 116.

Effluent from the tank is removed through a conduit 120. A portion of this effluent is recycled through a conduit 122 to the intake of pump 10 above described. Fluid discharged from this pump travels through a conduit 124 to be returned to header box 116 and reintroduced to the tank 110 through conduit 126.

Air is introduced to the effluent through conduit 72.

Air introduced into the pump through operation of the impeller is thoroughly mixed with the liquid sewage. Much of the air is mixed to become dissolved in the liquid sewage. Air not actually dissolved is felt to be contained in the liquid in the air bubbles sized below 150 microns.

The introduction to the tank of the recycled stream of sewage containing dissolved air and air dispersed as finely entrained bubbles, has the effect, as earlier discussed, of producing a separation in the tank, with pollutants separating as a sludge which if floating can be removed from the tank as a drawoff.

The system in FIG. 2 can be further simplified by introducing the air into the pump supplying the raw feed, thus eliminating the need for a recycle flow, and further reducing the complexity of the system.

With the construction described, appreciable quantities of air may be introduced into the pumpage with introduction of air in an amount exceeding approximately 15% by volume of the pumpage handled having been attained.

While an embodiment of the invention has been described, it is obvious that variations and modifications are possible without departing from the instant invention as claimed herein.

It is claimed and desired to secure by Letters Patent:

1. A method of conditioning a liquid by introducing air into the liquid using a rotating impeller for pumping the liquid comprising:

drawing liquid into the impeller at the front of the impeller and forcing the liquid over the front of the impeller toward the periphery of the impeller to produce a first liquid portion at the impeller periphery at a superatmospheric pressure, transferring a fraction of the liquid drawn to the back of the impeller, creating through rotation of the impeller a subatmospheric pressure in a region at the back of the impeller, drawing atmospheric air into said subatmospheric pressure region at the back of the impeller, mixing the transferred portion of the liquid through rotation of the impeller with this air to produce a liquid fraction containing air, and transporting this liquid fraction, containing air to the periphery of the impeller with such then mixing with the first liquid portion.

2. The method of claim 1, wherein the mixing is produced using stationary vanes facing the back of the impeller, the vanes intercepting liquid moved by the back of the impeller through rotation of the impeller.

3. A centrifugal pump comprising:

a casing and pump and seal chamber wails within the casing defining a pump chamber and a seal chamber, respectively, with the seal chamber to the rear of the pump chamber, a rotatable impeller disposed within the pump chamber and the impeller having a back facing the seal chamber, a shaft for the impeller supporting the impeller and the shaft extending through the seal chamber, vane structure joined to the seal chamber wall projecting into the seal chamber, and an air-introduction passage extending through the casing joining with said seal chamber at a region located to the rear of the back of the impeller, said passage admitting air into fluid in the seal chamber and said vane structure producing motion of fluid mixed with air outwardly from the seal chamber.

4. The pump of claim 3, wherein the impeller has vane structure projecting from the back thereof promoting mixing of air and fluid in said seal chamber.

5. The pump of claim 4, and which further includes a conduit connecting the pump chamber with the seal chamber at the back of the impeller.

6. The pump of claim 4, which further includes a conduit connectable with a water source communicating with the seal chamber.

7. A centrifugal pump including a casing, and the casing including pump and seal chamber walls spaced axially from each other and defining a pump chamber and a seal chamber, respectively, an impeller rotatably mounted within the casing having a front facing the pump chamber and a back facing the seal chamber, an air-introduction passage extending through said casing connecting said seal chamber with the atmosphere for the admission of atmospheric air into the seal chamber, a vane structure within the seal chamber producing mixing of air admitted through said passage with pumpage in the seal chamber.

8. The pump of claim 7, which further includes a conduit for transporting pumpage from the pump chamber to the seal chamber.

9. The pump of claim 7, which further includes a conduit connectable with a water source communicating with the seal chamber.

* * * * *